US011740005B2

(12) United States Patent
Park

(10) Patent No.: US 11,740,005 B2
(45) Date of Patent: Aug. 29, 2023

(54) EVAPORATING UNIT AND REFRIGERATOR HAVING THE SAME

(71) Applicant: LG Electronics Inc., Seoul (KR)

(72) Inventor: Haemin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/527,675

(22) Filed: Nov. 16, 2021

(65) Prior Publication Data

US 2022/0154998 A1 May 19, 2022

(30) Foreign Application Priority Data

Nov. 19, 2020 (KR) ..... 10-2020-0155758

(51) Int. Cl.
*F25D 21/12* (2006.01)
*F25B 39/02* (2006.01)
*F25B 13/00* (2006.01)

(52) U.S. Cl.
CPC ..... *F25D 21/12* (2013.01); *F25B 13/00* (2013.01); *F25B 39/028* (2013.01)

(58) Field of Classification Search
CPC ..... F25D 21/12; F25D 21/08; F25B 13/00; F25B 39/028; F25B 47/02
USPC ..... 62/277
See application file for complete search history.

(56) References Cited

U.S. PATENT DOCUMENTS

2018/0010843 A1 1/2018 Eom et al.
2021/0003339 A1* 1/2021 Picanço ..... F25D 17/045

FOREIGN PATENT DOCUMENTS

| | | | |
|---|---|---|---|
| JP | 2002039696 | 2/2002 | |
| KR | 100828491 | 5/2008 | |
| KR | 101297568 | 8/2013 | |
| KR | 20140110492 | 9/2014 | |
| KR | 20180006570 | 1/2018 | |
| KR | 20180006570 A * | 1/2018 | ..... F25D 19/00 |
| KR | 20180118877 | 11/2018 | |

OTHER PUBLICATIONS

Pdf file is original document of foreign referecne KR 20180006570 A (Year: 2018).*
Pdf is translation of foreign reference (Year: 2018).*
Office Action in Korean Appln. No. 10-2020-0155758, dated Dec. 20, 2021, 18 pages (with English translation).
Office Action in Korean Appln. No. 10-2020-0155758, dated Jun. 21, 2022, 18 pages (with English translation).

* cited by examiner

*Primary Examiner* — Henry T Crenshaw
*Assistant Examiner* — Kamran Tavakoldavani
(74) *Attorney, Agent, or Firm* — Fish & Richardson P.C.

(57) ABSTRACT

An evaporator unit includes an evaporator comprising an evaporation pipe and a plurality of heat exchange fins, through which the evaporation pipe penetrates, and a defrost heater mounted below the evaporator. The defrost heater may include a heating line and a heating pipe in which the heating line is accommodated, and the heating pipe may have a plurality of irregularities extending in a longitudinal direction of the heating pipe.

20 Claims, 5 Drawing Sheets

EVAPORATING UNIT AND REFRIGERATOR HAVING THE SAME

CROSS-REFERENCE TO RELATED APPLICATIONS

The present application claims priority under 35 U.S.C. 119 and 35 U.S.C. 365 to Korean Patent Application No. 10-2020-0155758, filed on Nov. 19, 2020, which is hereby incorporated by reference in its entirety.

FIELD

The present disclosure relates to an evaporating unit and a refrigerator having the same.

BACKGROUND

A refrigerator is a home appliance for storing food at a refrigerated or frozen temperature.

The refrigerator is provided with an evaporation chamber for cooling air in the refrigerator to a low temperature, and an evaporator which is a component of a refrigeration cycle is mounted in the evaporation chamber. A defrost water receiver is disposed below the evaporator, such that frost or ice separated from a surface of the evaporator in a defrost operation process is collected.

Meanwhile, a defrost heater such as a sheath heater is mounted on the bottom of the evaporator. Conventionally, a sheath heater having a shape of a pipe having flat inner and outer circumferential surfaces was applied.

Korean Patent Publication No. 10-0828491 as a prior art discloses an aluminum fin tube heater for agriculture, in which the area of a radiation fin is large in order to improve radiation efficiency and a radiation area.

An object of the prior art is to improve heat transfer efficiency by increasing a surface area through the aluminum fin. However, when applying a heater having a high amount of heat, there is still a problem that noise may generated due to expansion and contraction of the fin due to heating and cooling of a heater.

In addition, in case of a sheath heater currently applied to the refrigerator, as the safety standard needs to be satisfied, there is an upper limit in surface power density obtained by dividing the amount of heat by a heating area of the heater. It is difficult to design a heater having a high amount of heat while satisfying the upper limit of the power density.

SUMMARY

The present embodiment provides a refrigerator and an evaporator unit that solve a problem that a defrosting time increases due to a limit in setting the amount of heat due to the characteristics of the refrigerator which uses refrigerant because the surface temperature of a heater is relatively high during defrosting operation of the refrigerator.

The present embodiment provides a refrigerator and an evaporator unit capable of minimizing temperature rise in a storage compartment after defrosting and a possibility of causing frost defect.

The present embodiment provides a refrigerator and an evaporator unit capable of increasing the heating area of a heater without a noise problem and without needing to increase the mounting space of the heater.

An evaporator unit according to an aspect may include an evaporator comprising an evaporation pipe and a plurality of heat exchange fins, through which the evaporation pipe penetrates, and a defrost heater mounted below the evaporator, The defrost heater may include a heating line and a heating pipe in which the heating line is accommodated. The heating pipe may have a plurality of irregularities extending in a longitudinal direction of the heating pipe.

A depth of the irregularities may be determined by an outer diameter of the heating pipe, an outer diameter of the heating line and a thickness of the heating pipe.

The depth of the irregularities may be about 0.15 mm.

The heating pipe may include inner irregularities provided in an inner circumferential surface and extending in a longitudinal direction, and outer irregularities provided in an outer circumferential surface and extending in a longitudinal direction.

The inner irregularities may include a plurality of depressions recessed toward the outside of the heating pipe and a plurality of protrusions protruding toward the inside of the heating pipe.

The plurality of depressions and the plurality of protrusions may be alternately arranged in a circumferential direction of the heating pipe.

The outer irregularities may include a plurality of protrusions protruding toward the outside of the heating pipe and a plurality of valleys recessed toward the inside of the heating pipe.

The plurality of protrusions and the plurality of valleys may be alternately arranged in a circumferential direction of the heating pipe.

A depth of the inner irregularities and a depth of the outer irregularities may be the same.

A minimum distance from an outer circumferential surface of the heating line to the heating pipe may be about 1.5 mm.

The defrost heater may further include a lead wire, a cold pin having one end connected to an end of the lead wire, and a shrinkable tube covering an end of the heating pipe.

The defrost heater comprises an upper body extending in a horizontal direction and a lower body bent from the upper body and located below the upper body.

The lower body may include a first extension extending from the upper body, a second extension bent and extending from the first extension, and a bending point located between the first extension and the second extension.

The evaporator unit may further include a defrost water receiver mounted below the defrost heater to collect defrost water falling from the evaporator during defrosting operation.

The defrost water receiver may include a drain hole disposed below the bending point in a vertical direction to discharge the defrost water.

A refrigerator according to another aspect may include a cabinet comprising a storage compartment for storing food and an evaporation chamber for generating cold air, a door coupled to the cabinet to open and close the storage compartment, and an evaporator unit accommodated in the evaporation chamber.

The evaporator unit may include an evaporation pipe, a frame supporting the evaporation pipe, an evaporator comprising a plurality of heat exchange fins, through which the evaporation pipe penetrates, and a defrost heater mounted below the evaporator.

The defrost heater may include a heating line and a heating pipe in which the heating line is accommodated, and the heating pipe may have a plurality of irregularities extending in a longitudinal direction of the heating pipe.

The heating pipe may have a hollow cylindrical shape, and cross sections of inner and outer circumferential surfaces may have a wavy shape.

A depth of the irregularities may be determined by an outer diameter of the heating pipe, an outer diameter of the heating line and a thickness of the heating pipe.

DETAILED DESCRIPTION OF THE EMBODIMENTS

Figure 1:
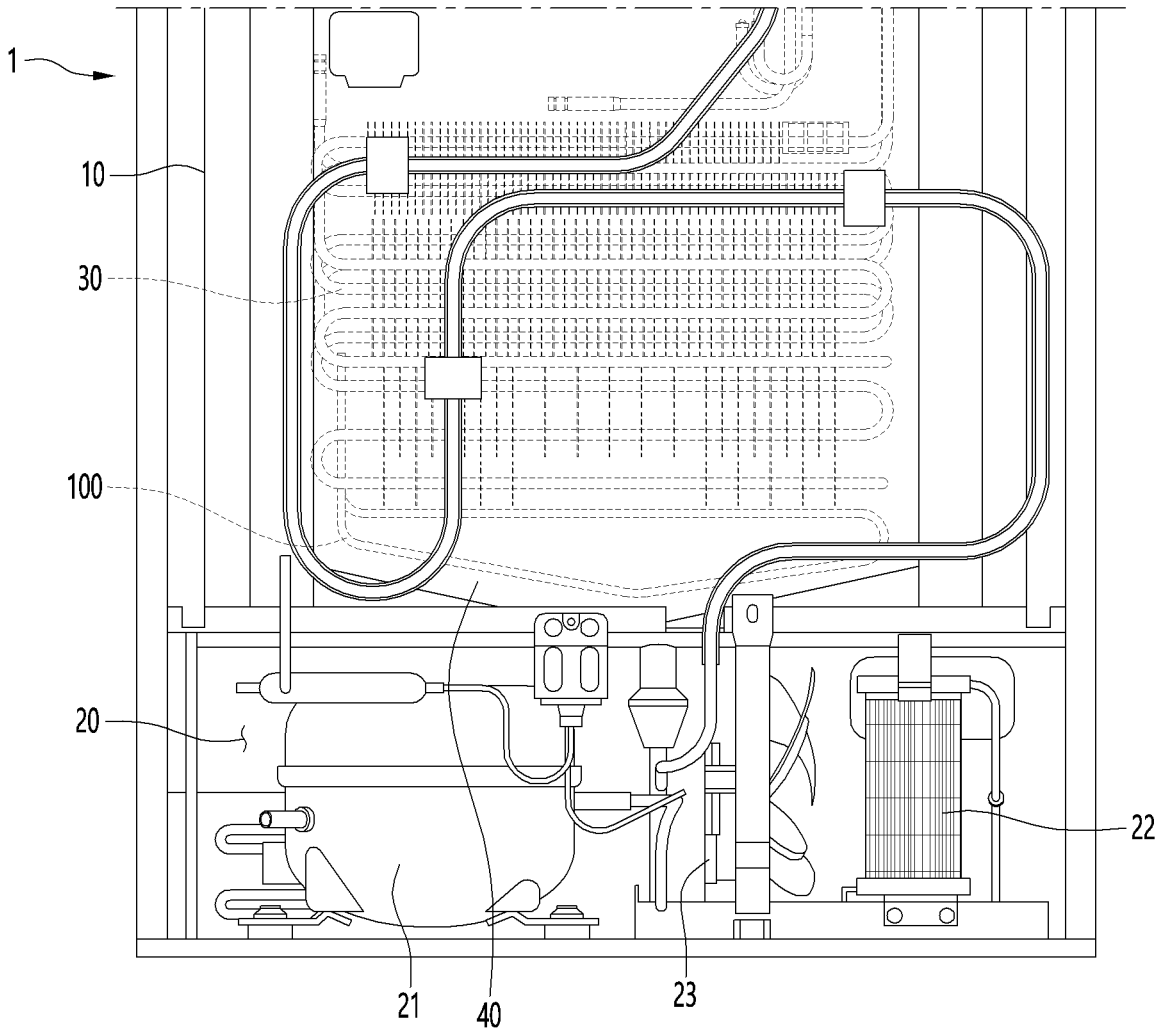
FIG. 1 is a rear view of a refrigerator according to an embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
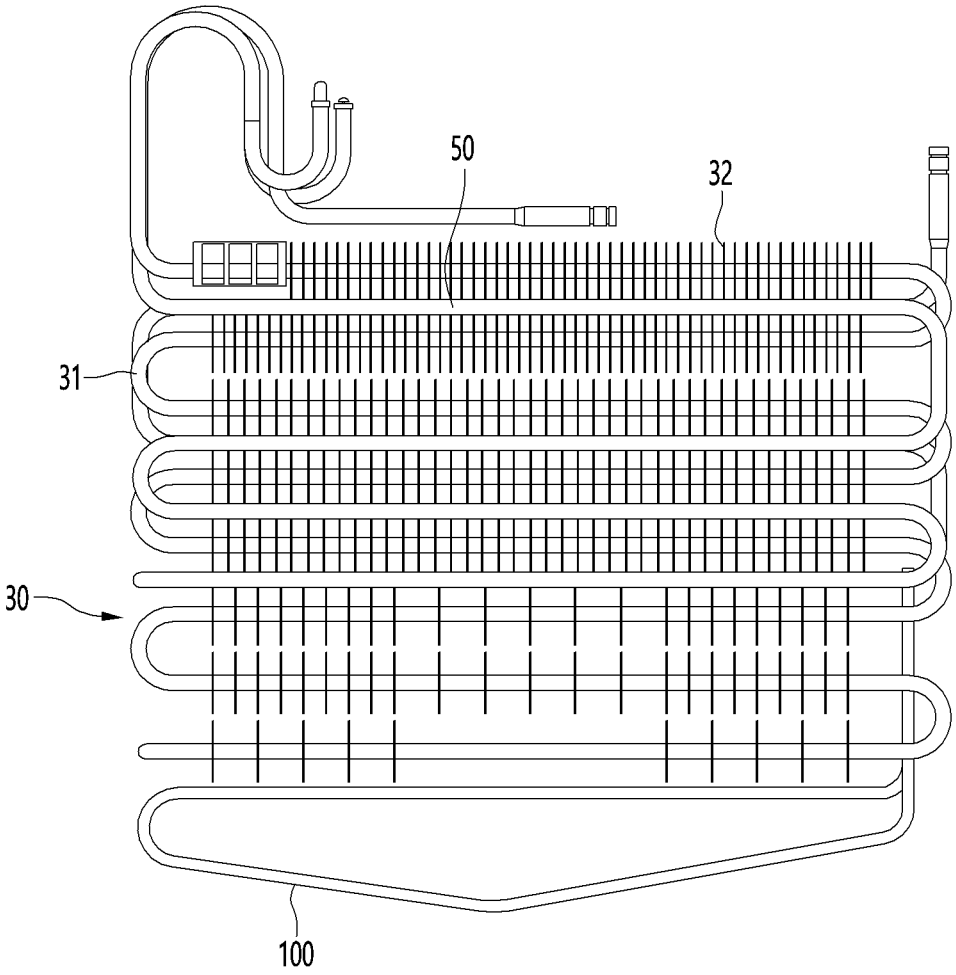
FIG. 2 is a front view of an evaporator unit according to an embodiment of the present disclosure.

FIG. 1 is a rear view of a refrigerator according to an embodiment of the present disclosure, and FIG. 2 is a front view of an evaporator unit according to an embodiment of the present disclosure.

Referring to FIG. 1, the refrigerator 1 according to the present embodiment may include a cabinet 10 having a storage compartment therein, a door rotatably coupled to a front surface of the cabinet 10 to open and close the storage compartment, and a cooling cycle for cooling the storage compartment.

The storage compartment may include a refrigerating compartment and a freezing compartment. A machine compartment 20 in which parts configuring the cooling cycle may be formed at the lower side of the rear surface of the cabinet 10. The machine compartment is shielded by a machine compartment cover, and external air suction and discharge grills may be formed in the machine compartment cover.

A refrigeration cycle provided in the refrigerator according to the present embodiment may include a compressor 21 for compressing refrigerant into high-temperature, high-pressure gaseous refrigerant, a condenser 22 for condensing the refrigerant discharged from the compressor 21 into high-temperature, high-pressure liquid refrigerant, a condensing fan 23 for forcibly flowing indoor air for heat exchange of indoor air, an expansion mechanism for expanding the refrigerant discharged from the condenser 22 into low-temperature, low-pressure two-phase refrigerant, and an evaporator 30 for evaporating the two-phase refrigerant passing through the expansion mechanism into low-temperature, low-pressure gaseous refrigerant.

The compressor 21, the condenser 22 and the condensing fan 23 may be disposed inside the machine compartment 20, and the evaporator 30 may be located behind the cabinet 10.

The condensing fan 23 may be disposed between the compressor 21 and the condenser 22.

Referring to FIG. 2, the evaporator unit according to the present embodiment may include an evaporator 30 in which cold air and refrigerant exchange heat, a first heater 50 disposed above the evaporator 30, a second heater 100 disposed below the evaporator 30, and a defrost water receiver 40 disposed below the evaporator 30 to collect frost or ice formed on a surface of the evaporator 30.

The evaporator 30 may include, as shown, an evaporation pipe 31 through which refrigerant passing through an expansion valve flows and a plurality of heat exchange fins 32 disposed side by side in a longitudinal direction of the evaporation pipe 31 and having the evaporation pipe 31 penetrating therethrough.

More specifically, the evaporation pipe 31 may be meanderingly bent to form a meander line. In addition, the plurality of heat exchange fins 32 may be arranged side by side in a line, and the evaporation pipe 31 sequentially penetrates through the plurality of heat exchange fins 32. Accordingly, the evaporation pipe 31 and the heat exchange fins 32 exchange heat by a heat conduction phenomenon, and the evaporation pipe 31 and the heat exchange fins 32 exchange heat with cold air of the evaporation chamber.

In addition, the defrost water receiver 40 is mounted on the bottom of the evaporation chamber to collect defrost water falling from the evaporator 30 during defrosting operation and to discharge the defrost water to the outside of the refrigerator.

Specifically, the defrost water receiver 40 may include a drain hole through which the defrost water is discharged, and may be inclined toward the drain hole.

That is, the drain hole may be located at the lowermost end of the defrost water receiver 40 such that the defrost water is discharged to the outside of the machine compartment or the refrigerator by gravity, and may cover at least a portion of the second heater 100.

The first heater 50 may include an L-cord heater, and the second heater 100 may include a sheath heater.

The L-cord heater and the sheath heater may be referred to as a defrost heater together.

The first heater 50 is disposed in a meander line along the upper portion of the front and rear surface and upper surface of the evaporator 30 to melt the frost adhered to the surface of the evaporator 30.

The second heater 100 may extend along the bottom and side surfaces of the evaporator 120.

The second heater 100 may include a body 110 disposed on a bottom surface of the evaporator 30, and the body 110 may be bent one or more times.

The second heater 100 may include an upper body 113 and a lower body 114 bent from the upper body 113 and disposed below the upper body 113, and the lower body 114 may be bent once.

For example, the lower body 114 may be inclined toward the defrost water drain hole of the defrost water receiver 40 in correspondence with the shape of the defrost water receiver 40.

By the above configuration, when the defrosting operation starts, flow of the refrigerant through the evaporation pipe 31 is stopped, and power is applied to the first heater 50 and the second heater 100. Then, the first heater 50 and the second heater 100 are heated to emit heat, thereby melting ice formed on the surface of the evaporator 30.

When the ice formed on the surface of the evaporator 30 melts, the ice slides by gravity and falls to the defrost water receiver 40. The ice falling to the defrost water receiver 40 is phase-changed into water and the water is collected in another defrost water receiver formed in the bottom of the machine compartment or is discharged to the outside of the refrigerator.

Hereinafter, the second heater 100 will be described in detail.

Figure 3:
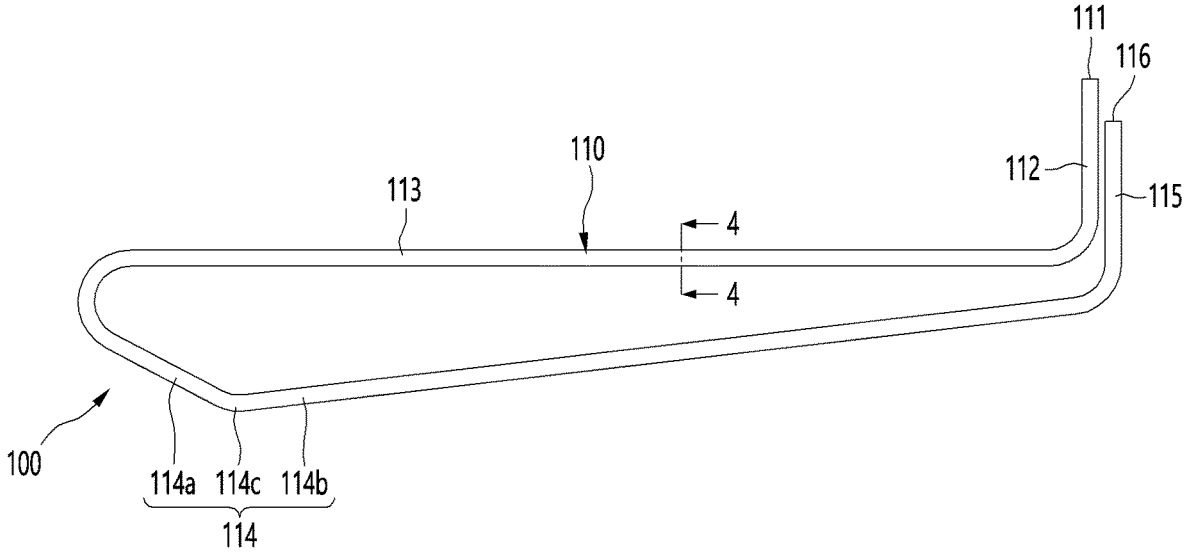
FIG. 3 is a front view of a second heater according to an embodiment of the present disclosure.
Figure 4:
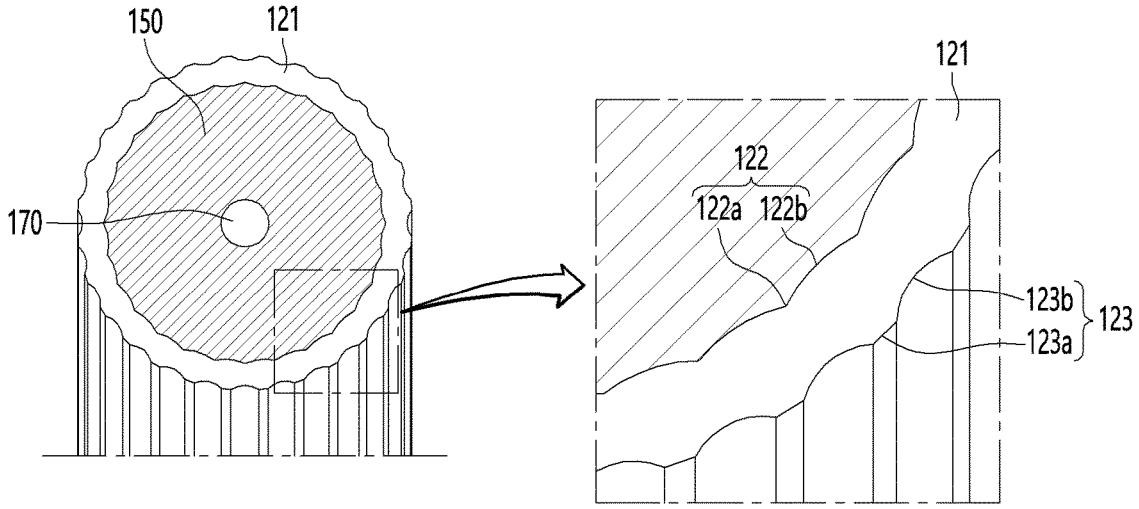
FIG. 4 is a cross-sectional view of a second heater according to an embodiment of the present disclosure.
Figure 5:
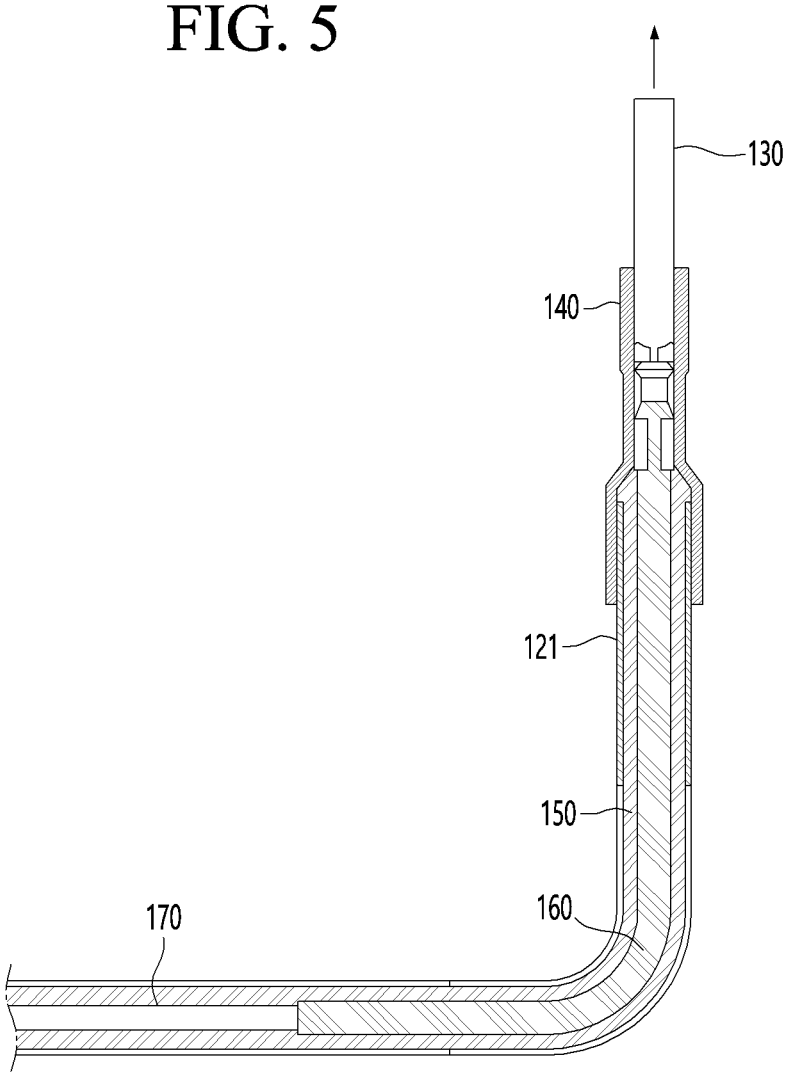
FIG. 5 is a longitudinal cross-sectional view of a second heater according to an embodiment of the present disclosure.

FIG. 3 is a front view of a second heater according to an embodiment of the present disclosure, FIG. 4 is a cross-sectional view of a second heater according to an embodiment of the present disclosure, and FIG. 5 is a longitudinal cross-sectional view of a second heater according to an embodiment of the present disclosure.

Referring to FIGS. 3 to 5, the second heater 100 may include an upper body 113 and a lower body 114 bent from the upper body 113 and disposed below the upper body 113.

For example, the lower body 114 may form an acute angle with the upper body 113.

The second heater 100 may include a first vertical portion 112 extending upward from the upper body 113 and a first end 111 connected with a lead wire 130 to be described later at an end of the first vertical portion 112.

The second heater 100 may include a second vertical portion 115 extending upward from the lower body 114 and a second end 116 connected with the lead wire 130 at an end of the second vertical portion 115.

Meanwhile, the lower body 114 may be formed in correspondence with the shape of the defrost water receiver 40.

The lower body 114 may include a first extension 114*a* and a second extension 114*b* bent and extending from the first extension 114*a*, and a bending point 114*c* may be included between the first extension 114*a* and the second extension 114*b*.

For example, the first extension 114*a* and the second extension 114*b* may form an angle of 90° or more.

The position of the bending point 114*c* may correspond to the position of the drain hole of the defrost water receiver 40.

Meanwhile, the second heater 100 may include a lead wire 130, a cold pin 160 having one end connected to an end of the lead wire, a heating line 170 connected to the other end of the cold pin 160, a heating pipe 121 in which the cold pin 160 and the heating line 170 are accommodated, and a shrinkable tube 140 covering the end of the heating pipe 121.

The cold pin 160 may be located in a portion of the inside of the heating pipe 121.

When the heating line 170 is directly connected to the lead wire 130, the coating of the lead wire 130 may be melted or peeled off by heat emitted from the heating line 170. In order to prevent this, the cold pin 160 is interposed to form a non-heating section. That is, even if power is applied to the lead wire 130, the cold pin 160 is not heated but only the heating line 170 is heated.

The cold pin 160 and the heating line 170 are accommodated in the heating pipe 121 made of a stainless steel (STS) material and may be protected from external impact.

A portion of the lead wire 130 and an outer circumferential surface of an end of the heating pipe 121 are surrounded by the shrinkable tube 140. When heat is applied to the shrinkable tube 140, the shrinkable tube shrinks due to its own properties. As a result, a connection portion of the lead wire 130 and the cold pin 160 may be sealed to perform a waterproof function and to prevent corrosion due to a potential difference between heterogeneous metals.

In other words, when the heating pipe 121 made of the stainless steel material and the evaporation pipe 31 made of an aluminum material come into direct contact, corrosion may occur due to the potential difference between heterogenous metals. However, when the shrinkable tube 140 is wound around the outer circumferential surface of the heating pipe 121, it is possible to prevent corrosion due to the potential difference between heterogenous metals.

Magnesium oxide (MgO) 150 for insulation may be disposed between the cold pin 160 of the second heater 100 and the heating pipe 121.

Meanwhile, referring to FIG. 4, the heating pipe 121 of the second heater 100 may have a plurality of irregularities.

Specifically, the heating pipe 121 may be a hollow pipe and the cross-sections of the inner and outer circumferential surfaces thereof may have a wavy shape.

For example, the inner circumferential surface may include an inner surface profile including inner irregularities that include a plurality of depressions 122*a*, which are recessed outward and extend along the longitudinal direction of the heating pipe 121, and a plurality of protrusions 122*b*, which protrude inward and extend along the longitudinal direction of the heating pipe 121.

In addition, the outer circumferential surface may include an outer surface profile including outer irregularities that include a protrusions 123*a* protruding outward and extending along the longitudinal direction of the heating pipe 121 and a plurality of valleys 123*b* recessed and extending along the longitudinal direction of the heating pipe 121.

That is, the heating pipe 121 may have a surface profile including a plurality of irregularities extending along the longitudinal direction of the heating pipe 121. The plurality of protrusions 123*a* and the plurality of valleys 123*b* are alternately arranged in the circumferential direction of the heating pipe 121. For instance, the plurality of irregularities may include protrusions and recesses.

Accordingly, the cross section viewed vertically in the longitudinal direction of the heating pipe 121 may include the plurality of irregularities in the inner and outer circumferential surfaces, as shown in FIG. 4.

In addition, due to the characteristics of the process of forming the plurality of irregularities in the heating pipe 121, the depressions 122*a* and the protrusions 123*a*, and the protrusions 122*b* and the valleys 123*b* correspond to each other. The plurality of depressions 122*a* and the plurality of protrusions 122*b* are alternately arranged in the circumferential direction of the heating pipe 121.

In other words, the depressions 122*a* and the protrusions 123*a*, and the protrusions 122*b* and the valleys 123*b* may be located on the same extension of a plurality of extensions extending outward from the center of the heating pipe 121.

The heating area of the heating pipe 121 may increase by the irregularities and defrosting efficiency may increase.

The defrost operation is performed by radiation and convective heat transfer. As the amount of heat and surface area of the second heater 100 increase, convection and radiant heat transfer amount increase and thus a defrosting time may be reduced compared to before.

In addition, as the defrosting time is reduced, increase in internal temperature is reduced due to absence of cooling operation during the defrosting time, the amount of continuously intruded external heat and heating of the defrost heater, and a cooling operation time of a recovery cycle after defrosting may also be reduced and thus overall power consumption may be improved.

Meanwhile, the irregularities of the surface of the heating pipe 121 may be generated through a press process after a reduction process, and the depth of the irregularities may be determined in consideration of a distance to the inner circumferential surface of the heating pipe 121 and the heating line 170 inside the heating pipe 121.

For example, the outer diameter of the heating pipe 121, the outer diameter of the heating line 170 and the thickness of the heating pipe 121 may be considered.

The depth of the irregularities may be a distance from an extension of a line contacting one of the depressions 122*a* to the protrusion 122*b* adjacent to the depression 122*a*.

The depth of the irregularities may be a distance from the extension of a line contacting one of the protrusions 123*a* to the valley 123*b* adjacent to the protrusion 123*a*.

That is, the depths of the inner irregularities 122 and outer irregularities 123 of the heating pipe 121 may be the same.

Specifically, the depth of the irregularities may be determined by the following equation.

(Outer diameter of heating pipe−(outer diameter of heating line+minimum required insulation distance×2+thickness of heating pipe×2))/2

As an example according to the above equation, the depth of the irregularities may be about 0.15 mm. For instance, a recess depth or protrusion height of the irregularities may be between 0.1 mm and 0.2 mm.

In addition, a distance from the heating line 170 to the inner circumferential surface of the heating pipe 121, that is, a distance from the outer circumferential surface of the heating line 170 to the protrusion 122*b* of the inner irregularities of the heating pipe 121, may be equal to or greater than a minimum required insulation distance.

In some implementations, the minimum required insulation distance may be about 1.5 mm. For example, the minimum distance may be between 1 mm and 2 mm.

In addition, the irregularities may be processed based on the heating pipe 121 formed in a circular shape after the reduction process, in order to prevent insulation breakdown due to damage of the heating pipe 121 during the press operation.

Figure 6:
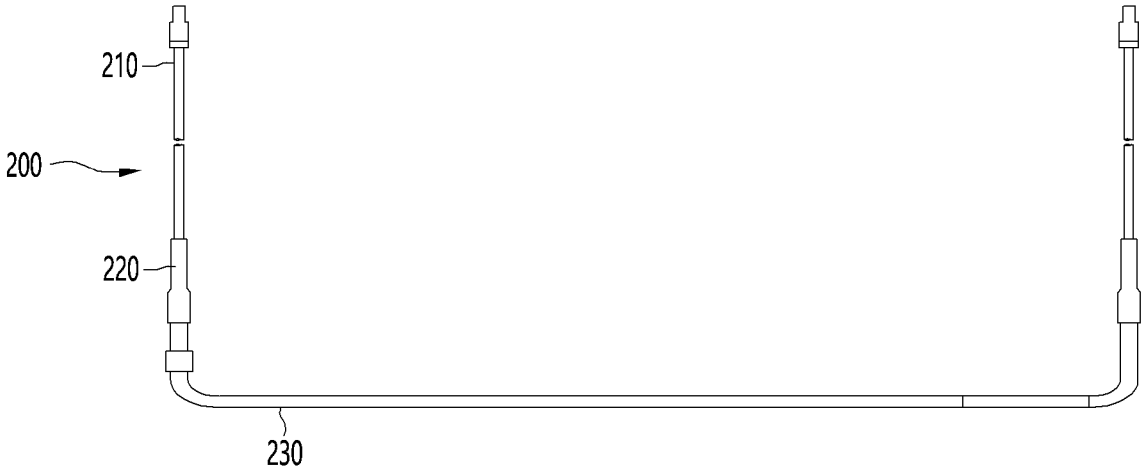
FIG. 6 is a front view of a second heater according to another embodiment of the present disclosure.

FIG. 6 is a front view of a second heater according to another embodiment of the present disclosure.

The second heater 200 may have lead wires 210 spaced apart from each other on both sides thereof, and the lead wires 210 may be connected by a heating pipe 230.

That is, the second heater 200 has a "C" shape, and the shrinkable tube 220 may be disposed between the lead wires 210 and the heating pipe 230, for insulation between the lead wires 210 and the heating pipe 230.

Regardless of the shape of the second heater 200 including the heating pipe 230, a plurality of irregularities extending in the longitudinal direction of the heating pipe 230 may be formed, thereby increasing a heating area.

The evaporator unit and the refrigerator including the same according to the present embodiment have the following effects.

The heating area may increase through the shape of the heater pipe including the plurality of irregularities, surface power density may be reduced compared to a heater having the same length and a heater having a high amount of heat may be designed compared to before.

In addition, by reducing the defrosting time through design of the heater having a high amount of heat, it is possible to reduce the amount of wet steam flowing into the refrigerator and to reduce failure due to frost.

In addition, by reducing the defrosting time and decreasing the internal temperature of the refrigerator increasing during defrosting, it is possible to maintain the freshness of food in the refrigerator.

In addition, by reducing the cooling operation time of the recovery cycle after defrosting in order to decrease the internal temperature of the refrigerator increasing after defrosting, it is possible to improve power consumption.

What is claimed is:

1. An evaporator unit comprising:

a plurality of heat exchange fins that are arranged horizontally along a line;

an evaporation pipe passing through the plurality of heat exchange fins; and a defrost heater disposed below the plurality of heat exchange fins, the defrost heater comprising:

a heating pipe having a cylindrical shape and horizontally extending in a longitudinal direction, a heating line accommodated in a space of the heating pipe, and magnesium oxide (MgO) provided in the space of the heating pipe, wherein the heating pipe comprises:

an inner surface profile that extends horizontally in the longitudinal direction, the inner surface profile having inner depressions in a radial direction of the heating pipe and inner protrusions in the radial direction, and an outer surface profile that extends horizontally in the longitudinal direction, the outer surface profile having outer protrusions in the radial direction and outer valleys in the radial direction.

2. The evaporator unit of claim 1, wherein a depth of the inner surface profile and a depth of the outer surface profile in the radial direction are determined based on an outer diameter of the heating pipe, an outer diameter of the heating line, and a thickness of the heating pipe.

3. The evaporator unit of claim 2, wherein the depth of the inner surface profile and the depth of the outer surface profile are about 0.15 mm.

4. The evaporator unit of claim 2, wherein the inner surface profile is defined at an inner circumferential surface of the heating pipe, and wherein the outer surface profile is defined at an outer circumferential surface of the heating pipe.

5. The evaporator unit of claim 4, wherein the inner depressions are recessed toward the outer circumferential surface of the heating pipe, and wherein the inner protrusions protrude from the inner circumferential surface of the heating pipe toward the heating line.

6. The evaporator unit of claim 5, wherein the inner depressions and the inner protrusions are alternately arranged along a circumferential direction of the heating pipe.

7. The evaporator unit of claim 4, wherein the outer protrusions that protrude outward from the outer circumferential surface of the heating pipe, and wherein the outer valleys are recessed toward the inner circumferential surface of the heating pipe.

8. The evaporator unit of claim 7, wherein the outer protrusions and the outer valleys are alternately arranged along a circumferential direction of the heating pipe.

9. The evaporator unit of claim 4, wherein the depth of the inner surface profile is equal to the depth of the outer surface profile.

10. The evaporator unit of claim 1, wherein a minimum distance between an outer circumferential surface of the heating line and the heating pipe is about 1.5 mm.

11. The evaporator unit of claim 1, wherein the defrost heater further comprises:

a lead wire;

a cold pin having one end connected to an end of the lead wire; and a shrinkable tube that covers an end of the heating pipe.

12. The evaporator unit of claim 1, wherein the heating pipe comprises:

an upper body that extends in a horizontal direction; and a lower body that is bent from the upper body and located vertically below the upper body.

13. The evaporator unit of claim 12, wherein the lower body comprises:

a first extension that extends from the upper body; and a second extension that extends from the first extension and is bent from the first extension at a bending point located between the first extension and the second extension.

14. The evaporator unit of claim 13, further comprising:

a defrost water receiver that is disposed vertically below the defrost heater and configured to collect defrost water fallen from the evaporation pipe or the plurality of heat exchange fins, the defrost water receiver including a drain hole that is defined vertically below the bending point and configured to discharge the defrost water.

15. A refrigerator comprising:

a cabinet that defines (i) a storage compartment configured to store food and (ii) an evaporation chamber configured to generate cooling air for cooling the storage compartment;

a door coupled to the cabinet and configured to open and close at least a portion of the storage compartment; and an evaporator unit accommodated in the evaporation chamber, the evaporator unit comprising:

a plurality of heat exchange fins that are arranged horizontally along a line, an pipe passing through the plurality of heat exchange fins, and a defrost heater disposed below the plurality of heat exchange fins, wherein the defrost heater comprises:

a heating pipe having a cylindrical shape and horizontally extending in a longitudinal direction, a heating line accommodated in a space of the heating pipe, and magnesium oxide (MgO) provided in the space of the heating pipe, wherein the heating pipe comprises:

an inner surface profile that extends horizontally in the longitudinal direction, the inner surface profile having inner depressions in a radial direction of the heating pipe and inner protrusions in the radial direction, and an outer surface profile that extends horizontally in the longitudinal direction, the outer surface profile having outer protrusions in the radial direction and outer valleys in the radial direction.

16. The refrigerator of claim 15, wherein the heating pipe has a hollow shape, wherein a cross section of an inner circumferential surface of the heating pipe has a wavy shape defined by the inner surface profile, and wherein a cross section of an outer circumferential surface of the heating pipe has a wavy shape defined by the outer surface profile.

17. The refrigerator of claim 15, wherein a depth of the inner surface profile and a depth of the outer surface profile in the radial direction are determined based on an outer diameter of the heating pipe, an outer diameter of the heating line, and a thickness of the heating pipe.

18. The refrigerator of claim 15, wherein the defrost heater further comprises:

a lead wire;

a cold pin having one end connected to an end of the lead wire; and a shrinkable tube that covers an end of the heating pipe.

19. The refrigerator of claim 15, wherein the heating pipe comprises:

an upper body that extends in a horizontal direction; and a lower body that is bent from the upper body and located vertically below the upper body.

20. The refrigerator of claim 15, wherein the inner depressions are defined at an inner circumferential surface of the heating pipe and recessed toward an outer circumferential surface of the heating pipe, wherein the inner protrusions protrude from the inner circumferential surface of the heating pipe toward the heating line, wherein the outer protrusions protrude outward from the outer circumferential surface of the heating pipe, and wherein the outer valleys are defined at the outer circumferential surface of the heating pipe and recessed toward the inner circumferential surface of the heating pipe.

* * * * *